US010842279B2

(12) United States Patent
Chen et al.

(10) Patent No.: US 10,842,279 B2
(45) Date of Patent: Nov. 24, 2020

(54) FOLDING CHAIR AND FOLDING MECHANISM

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 16/543,640

(22) Filed: Aug. 19, 2019

(65) Prior Publication Data

US 2020/0323346 A1 Oct. 15, 2020

(30) Foreign Application Priority Data

Apr. 10, 2019 (CN) ..... 2019 1 0283502

(51) Int. Cl.
*A47C 4/28* (2006.01)
*A47C 4/30* (2006.01)

(52) U.S. Cl.
CPC ..... *A47C 4/286* (2013.01); *A47C 4/30* (2013.01)

(58) Field of Classification Search
CPC .. A47C 4/286; A47C 4/30; A47C 4/28; A47C 4/24; A47C 4/34; A47C 4/38; A47C 4/44; A47C 4/48; A47C 4/14; A47C 4/10; A47C 4/20
See application file for complete search history.

(56) References Cited

U.S. PATENT DOCUMENTS 8,864,222 B2 * 10/2014 Grace ..... A47C 4/045 297/44
10,051,954 B2 * 8/2018 Grace ..... A47C 17/645
10,206,510 B2 * 2/2019 Choi ..... A47C 4/286
2010/0237665 A1 * 9/2010 Grace ..... A47C 4/46 297/16.2

FOREIGN PATENT DOCUMENTS

DE 202016103648 U1 * 7/2016 ..... A47C 5/06

* cited by examiner

*Primary Examiner* — Milton Nelson, Jr.
(74) *Attorney, Agent, or Firm* — Bayramoglu Law Offices LLC

(57) ABSTRACT

A folding chair includes two folding mechanisms which are symmetrical about the first plane, a first X-shaped folding frame and a second X-shaped folding frame. The folding mechanism includes a first supporting rod, a second supporting rod, a first active rod, a second active rod, a first connecting rod; and a first X-shaped folding frame. The first X-shaped folding frame includes two first transmission rods, and middle portions of the two first transmission rods are hinged at an eighth hinge point. The two first transmission rods can rotate around a seventh axis passing through a seventh hinge point. The second X-shaped folding frame includes two second transmission rods. Middle portions of the two second transmission rod are hinged at the eighth hinge point, and the two second transmission rods can rotate around an eighth axis passing through the eighth hinge joint.

30 Claims, 11 Drawing Sheets

FOLDING CHAIR AND FOLDING MECHANISM

CROSS REFERENCE TO THE RELATED APPLICATIONS

This application is based upon and claims priority to Chinese Patent Application No. 201910283502.2, filed on Apr. 10, 2019, the entire contents of which are incorporated herein by reference.

TECHNICAL FIELD

The present disclosure relates to the field of household products, in particular to a folding chair and a folding mechanism.

BACKGROUND

The chair is a piece of common furniture in daily life. People invented folding chairs for readily using and storing. Although the existing folding chair can be folded, there are general problems due to a cumbersome folding process, large space occupancy after folding, and an unstable structure after unfolding. Therefore, it is imperative to improve the prior art and develop a folding chair that is easy to fold, occupies a small space after folding and has a stable structure after unfolding.

SUMMARY

The problem to be addressed by the present disclosure is that the folding process is cumbersome, the space occupied after folding is large, and the structure after unfolding is not stable. The present disclosure provide a folding chair and a folding mechanism to resolve the mentioned problem.

The technical solution of the present disclosure is as follows: a folding mechanism includes a first supporting rod, a second supporting rod, a first active rod, a second active rod, and a first connecting rod; wherein a first end portion of the first supporting rod and a first end portion of the second supporting rod are hinged at a first hinge point; the first supporting rod and the second supporting rod are configured to rotate around a first axis passing through the first hinge point;

the first connecting rod and the second supporting rod are hinged at a second hinge point; the second hinge point is closer to the second end portion of the second supporting rod than the first hinge point; the second hinge point is located between a first end portion and a second end portion of the first connecting rod; the first connecting rod and the second supporting rod are configured to rotate around a second axis passing through the second hinge point;

the first active rod and the first supporting rod are hinged at a third hinge point, the third hinge point is closer to a second end portion of the first supporting rod than the first hinge point; the third hinge point is located between a first end portion and a second end portion of the first active rod; the first active rod and the first supporting rod are configured to rotate around a third axis passing through the third hinge point;

a second end portion of the second active rod and the second end portion of the first active rod are hinged at a fourth hinge point; the second active rod and the first active rod are configured to rotate around a fourth axis passing through the fourth hinge point;

the second active rod is fitted with a first sliding sleeve in a sliding manner, the first end portion of the first connecting rod and the first sliding sleeve are hinged at a fifth hinge point, the first sliding sleeve and the first connecting rod are configured to rotate around a fifth axis passing through the fifth hinge point;

the first supporting rod is fitted with a second sliding sleeve in a sliding manner; the second sliding sleeve is closer to the second end portion of the first supporting rod than the third hinge point; the second end portion of the first connecting rod and the second sliding sleeve are hinged at a sixth hinge point, the second sliding sleeve and the first connecting rod are configured to rotate around a sixth axis passing through the sixth hinge point; and the first axis, the second axis, the third axis, the fourth axis, the fifth axis, and the sixth axis are parallel to each other.

Preferably, the folding mechanism further includes a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other.

Preferably, the first end portion of the second limiting rod is fixedly provided with a limiting block, the limiting block and the second end portion of the first supporting rod are respectively located at two sides of the second supporting rod.

Preferably, the second supporting rod is fitted with a fifth sliding sleeve in a sliding manner, and the fifth sliding sleeve is closer to the second end portion of the second supporting rod than the second hinge point;

the fifth sliding sleeve is hinged to the first active rod and/or the second active rod, and a hinge shaft and the first axis are parallel to each other.

Preferably, the folding mechanism further includes a first limiting rod, a first end portion of the first limiting rod and the first active rod are hinged at a ninth hinge point, the ninth hinge point is closer to the first end portion of the first active rod than the third hinge point, the first limiting rod and the first active rod are configured to rotate around a ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around the fifteenth axis passing through the fifteenth hinge point; and the ninth axis, the fifteenth axis, and the first axis are parallel to each other.

Preferably, the folding mechanism further includes an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around the seventeenth axis passing through the seventeenth hinge point; and the sixteenth axis, the seventeenth axis, and the first axis are parallel to each other.

A folding chair includes two folding mechanisms, wherein the two folding mechanisms are symmetrical about a first plane; the first axis is perpendicular to the first plane;

the folding chair includes a first X-shaped folding frame and a second X-shaped folding frame;

the first X-shaped folding frame includes two first transmission rods, and middle portions of the two first transmission rods are hinged at a seventh hinge point, the two first transmission rods are configured to rotate around a seventh hinge axis passing through the seventh hinge point, and the seventh axis is located on the first plane;

a first connecting component is hinged to the first active rod, the first active rod and the first connecting component are hinged to the ninth hinge point, and the first active rod and the first connecting component are configured to rotate around the ninth axis;

the second end portion of the first supporting rod is hinged to a second connecting component, the second end portion of the first supporting rod and the second connecting component are hinged at a tenth hinge point, and the first supporting rod and the second connecting component are configured to rotate around a tenth axis passing through the tenth hinge point, and the tenth axis is perpendicular to the first plane;

first end portions of the two first transmission rods and the first connecting component are respectively hinged at two eleventh hinge points, the two eleventh axes respectively pass through the two eleventh hinge points and are parallel to the seventh axis, each first transmission rod and the first connecting component are configured to rotate around the tenth axis passing through the first transmission rod and the first connecting component;

second end portions of the two first transmission rods and two second connecting components are respectively hinged at two twelfth hinge points, the two twelfth axes respectively pass through the two twelfth hinge points and are parallel to the seventh axis, and each first transmission rod and the second connection component are configured to rotate around the twelfth axis passing through themselves the first transmission rod and the second connection component;

the second X-shaped folding frame includes two second transmission rods, middle portions of the two second transmission rods are hinged at the eighth hinge point, the two second transmission rods are configured to rotate around the eighth hinge axis passing through the eighth hinge point, and the eighth axis is located on the first plane;

the first active rod is hinged with a third connecting component; the third connecting component and the first active rod are hinged at the fourth hinge point; the third connecting component is configured to rotate around the fourth axis;

first end portions of the two second transmission rods and the two first sliding sleeves are respectively hinged at two thirteenth hinge point, and two thirteenth axes respectively pass through the two thirteenth hinge points and are parallel to the eighth axis, and each second transmission rod and each first sliding sleeve are configured to rotate around a thirteenth axis passing through the second transmission rod; and second end portions of the two second transmission rods and two third connecting components are respectively hinged at two fourteenth hinge points, two fourteenth axes respectively pass through the two fourteenth hinge points and are parallel to the eighth axis, and each second transmission rod and each third connecting component are configured to rotate around a fourteenth axis passing through themselves.

Preferably, the folding chair further includes a cloth surface, four sleeves are sewed on the cloth surface, and the two second active rods and first active rods are respectively inserted into the four sleeves.

The advantages of the present disclosure is that: the folding and unfolding process of the folding chair is simple, the space occupied after folding is small, and the structure after unfolding is stable.

BRIEF DESCRIPTION OF THE DRAWINGS

The present disclosure is described hereinafter in detail with reference to the embodiments and drawings.

Figure 1:
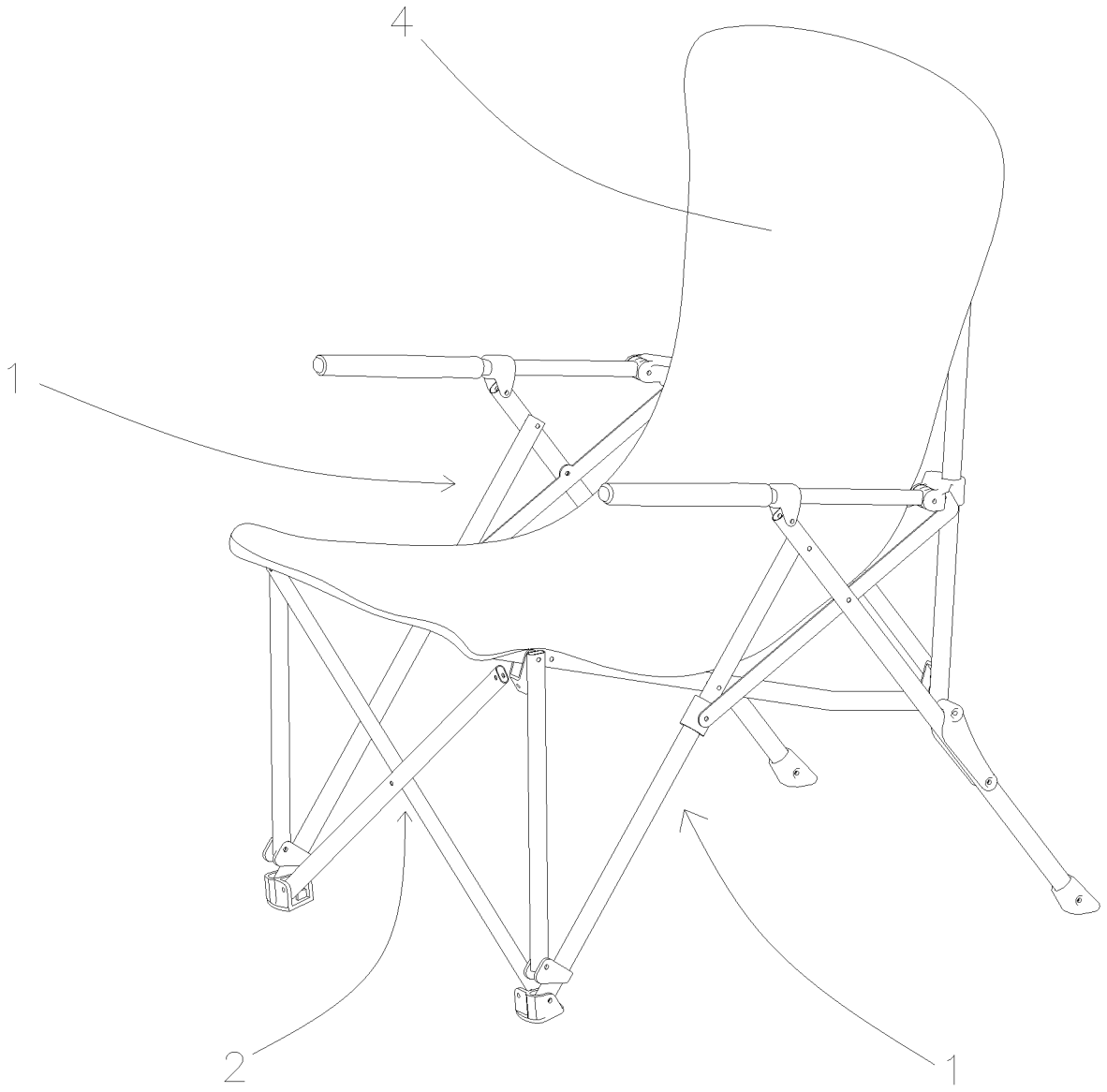
FIG. 1 is a structural schematic diagram showing a best mode embodiment of a folding chair the present disclosure.

In the figures: 1, folding mechanism, 2, first X-shaped folding frame, 3, second X-shaped folding frame, 4, cloth surface, 101, first supporting rod, 102, second supporting rod, 103, first active rod, 104, second active rod, 105, first connecting rod, 106, first limiting rod, 107, armrest rod, 108, second limiting rod, 109, limiting block, 201, first transmission rod, 301, second transmission rod, 501, first sliding sleeve, 502, second sliding sleeve, 503, third sliding sleeve,

504, fourth sliding sleeve, 601, first connecting component, 602, second connecting component, 603, third connecting component, 701, first hinge point, 702, second hinge point, 703, third hinge point, 704, fourth hinge point, 705, fifth hinge point, 706, sixth hinge point, 707, seventh hinge point, 708, eighth hinge point, 709, ninth hinge point, 7010, tenth hinge point, 7011, eleventh hinge point, 7012, twelfth hinge point, 7013, thirteenth hinge point, 7014, fourteenth hinge point, 7015, fifteenth hinge point, 7016, sixteenth hinge point, 7017, seventeenth hinge point, 7018, eighteenth hinge point.

DETAILED DESCRIPTION OF THE EMBODIMENTS

The embodiments of the present disclosure will be described in detail hereinafter, and the designators of the embodiments are illustrated in the drawings, wherein the same or similar reference numbers throughout the specification represent the same or similar elements or elements having same or similar functions. The embodiments described hereinafter with reference to the drawings are illustrative and intended to explain the present disclosure, rather than limiting the present disclosure.

In the description of the present disclosure, it should be understood that the orientation and the positional relationship indicated by the terms 'center', 'longitudinal', 'transverse', 'length', 'width', 'thickness', 'upper', 'lower', 'front', 'back', 'left', 'right', 'vertical', 'horizontal', 'top', 'bottom', 'inside', 'outside', 'axial', 'radial', 'circumferential', etc. are based on the orientation or the positional relationship shown in the drawings, and is merely for conveniently and simply describing the disclosure, rather than indicating or implying that the device or component referred to has a specific orientation, and composed or operated in the specific orientation, thereby forming no limit to the present disclosure.

Moreover, the terms 'first', 'second', etc. are merely used for descriptive purposes and should not be understood as indicating or implying the relative importance. In the description of the present disclosure, it should be noted that the terms 'interconnect' and 'connect' should be understood broadly, such as a fixed connection, a detachable connection, an integral connection; a mechanical connection, or an electrical connection; a direct connection or an indirect connection through a medium, unless otherwise explicitly defined and limited. The specific meaning of the above terms in the present disclosure can be understood in a specific case by those skilled in the art. Further, in the description of the present disclosure, the meaning of 'a plurality' means two or more unless otherwise specified.

Figure 2:
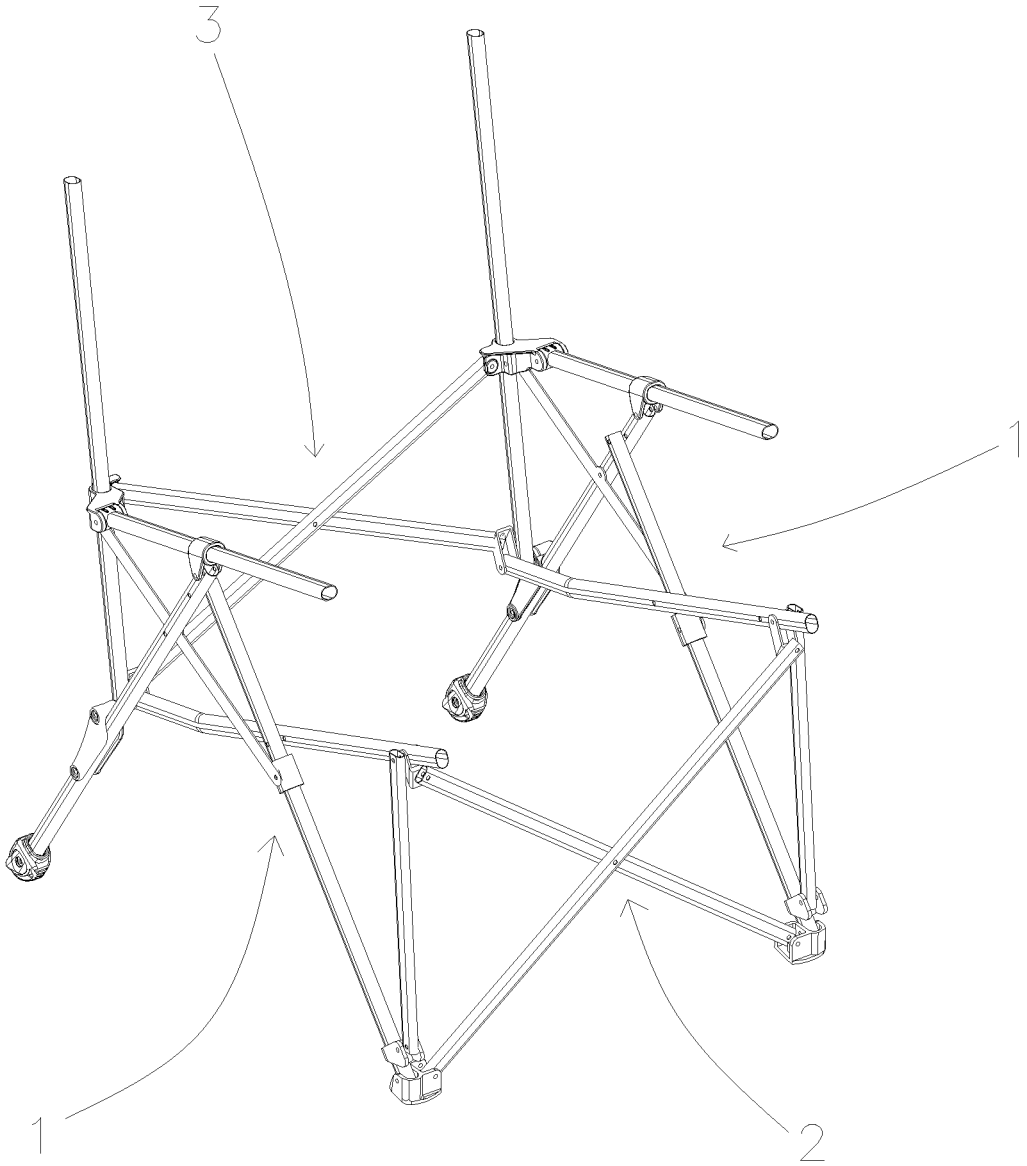
FIG. 2 is a partial structural schematic diagram showing the best mode embodiment of the folding chair according to the present disclosure.
Figure 3:
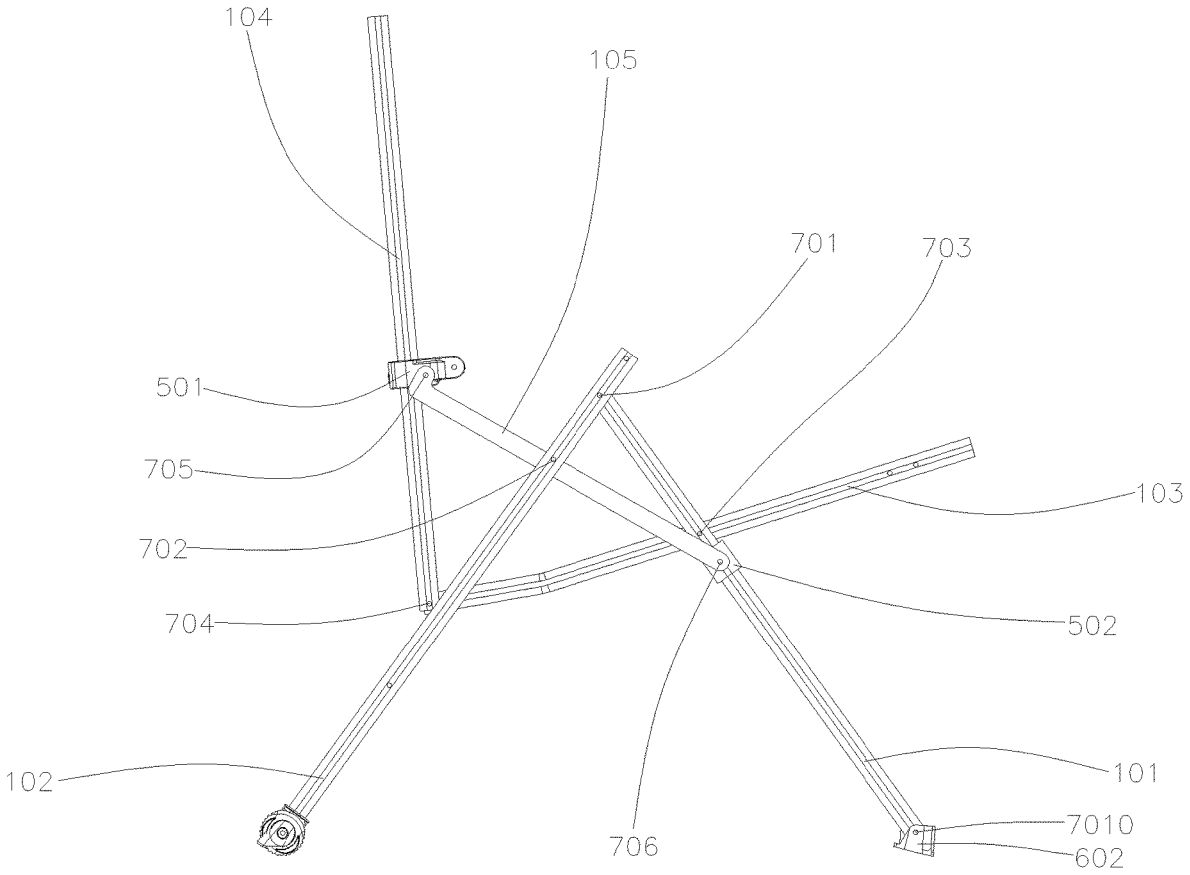
FIG. 3 is a partial structural schematic diagram showing a folding mechanism of the best mode embodiment of the folding chair according to the present disclosure.
Figure 4:
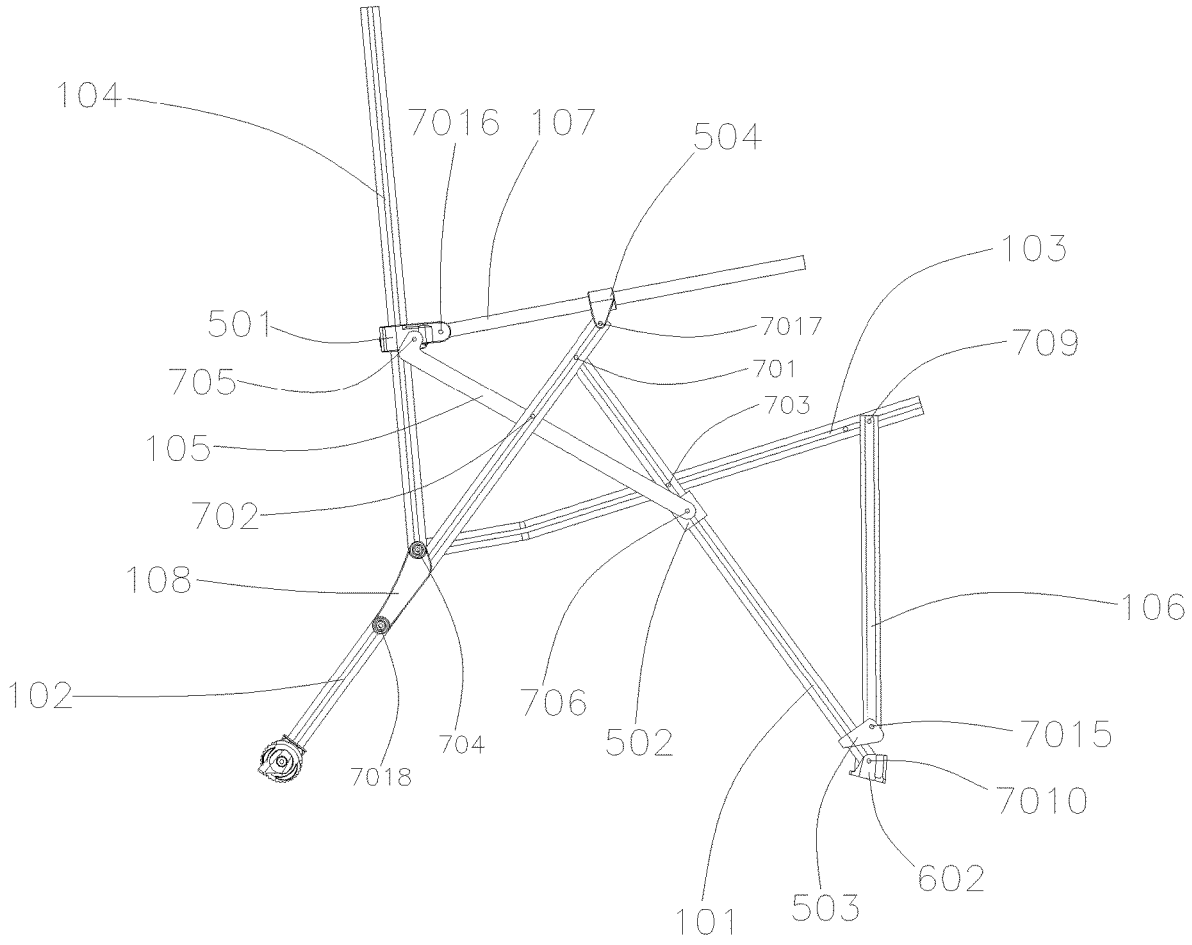
FIG. 4 is a structural schematic diagram showing the best mode embodiment of the folding chair according to the present disclosure.
Figure 5:
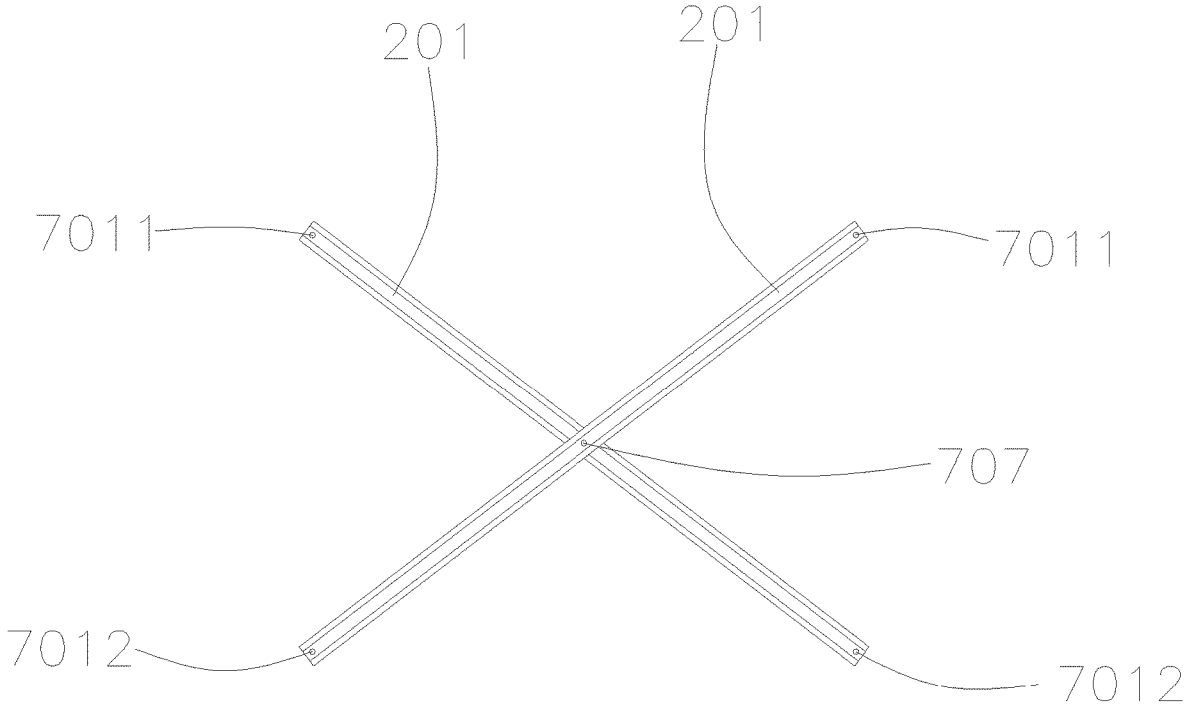
FIG. 5 is a structural schematic diagram showing a first X-shaped folding frame of the best mode embodiment of the folding chair according to the present disclosure.
Figure 6:
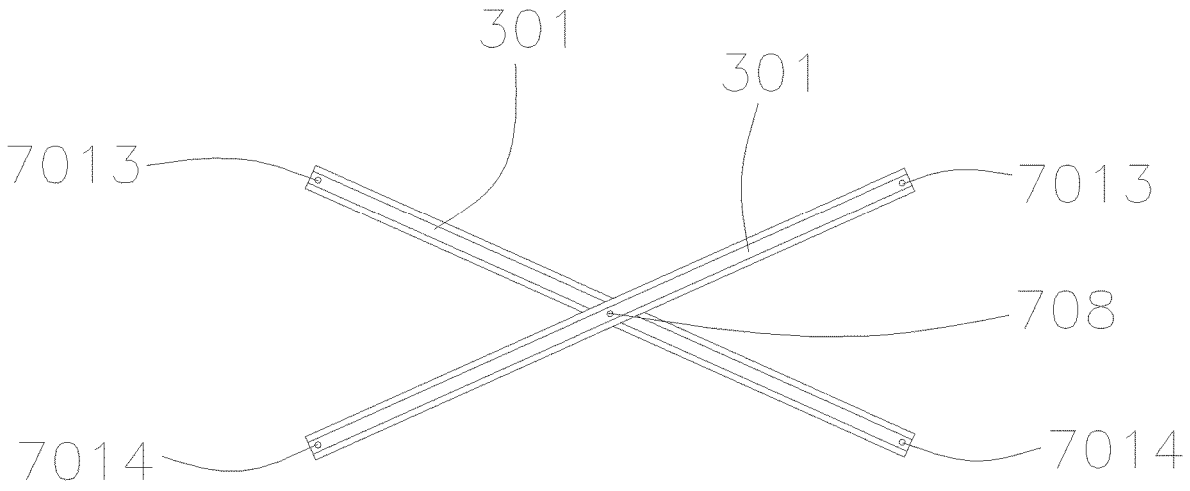
FIG. 6 is a structural schematic diagram showing a second X-shaped folding frame of the best mode embodiment of the folding chair according to the present disclosure.
Figure 7:
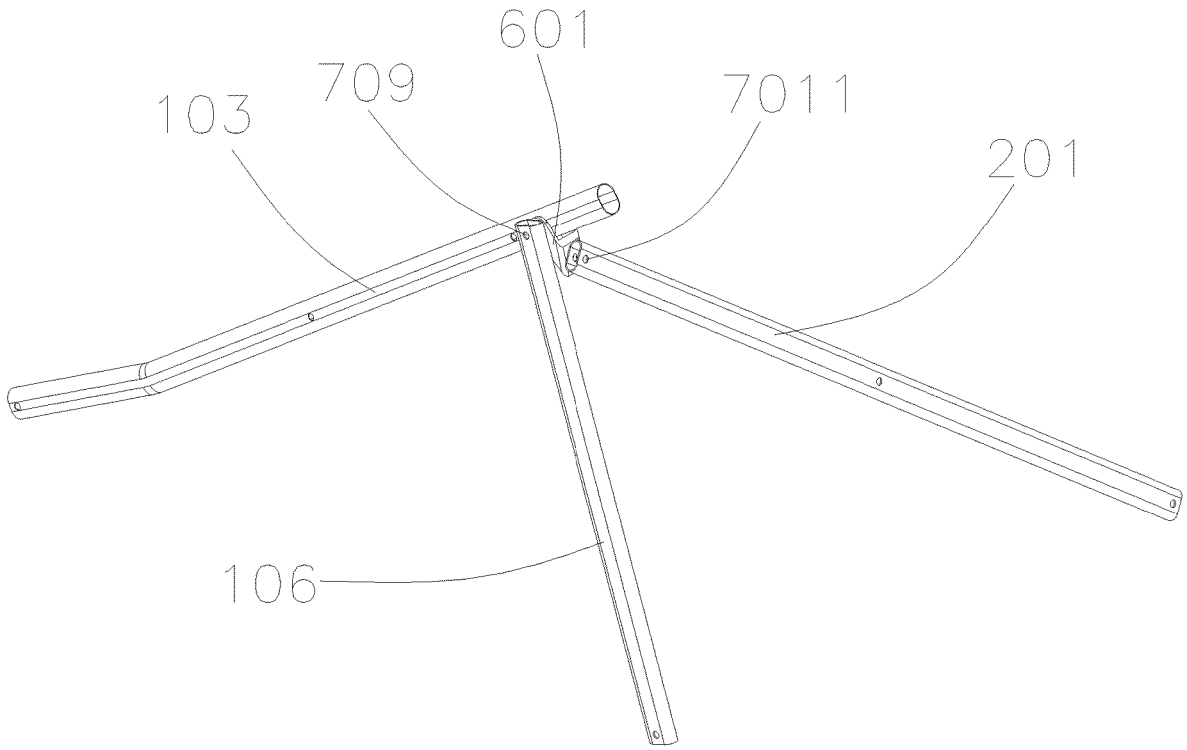
FIG. 7 is a structural schematic diagram showing the connection of a first active rod, a first transmission rod, a first limiting rod and a first connecting component.
Figure 8:
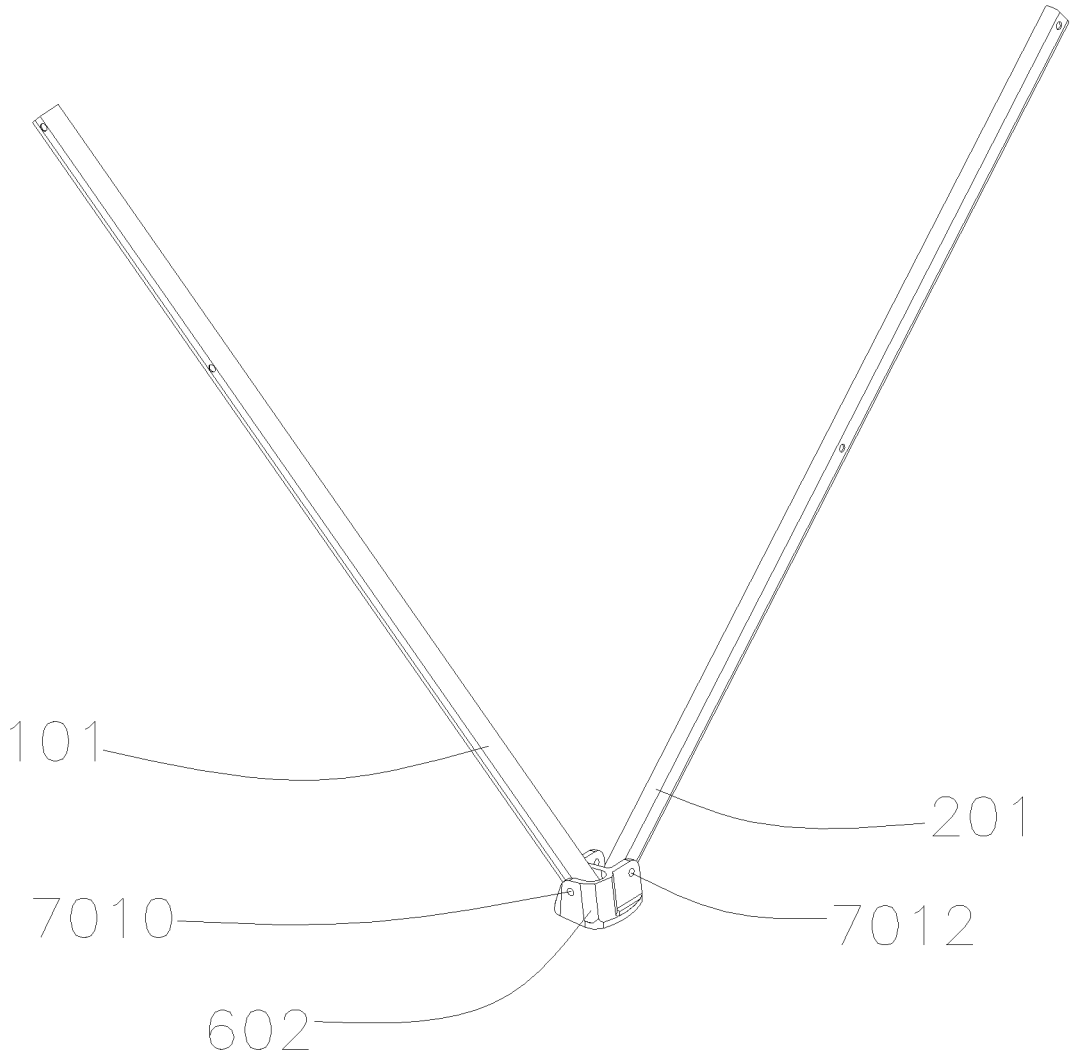
FIG. 8 is a structural schematic diagram showing the connection of a first supporting rod, the first transmission rod, and a second connecting component.
Figure 9:
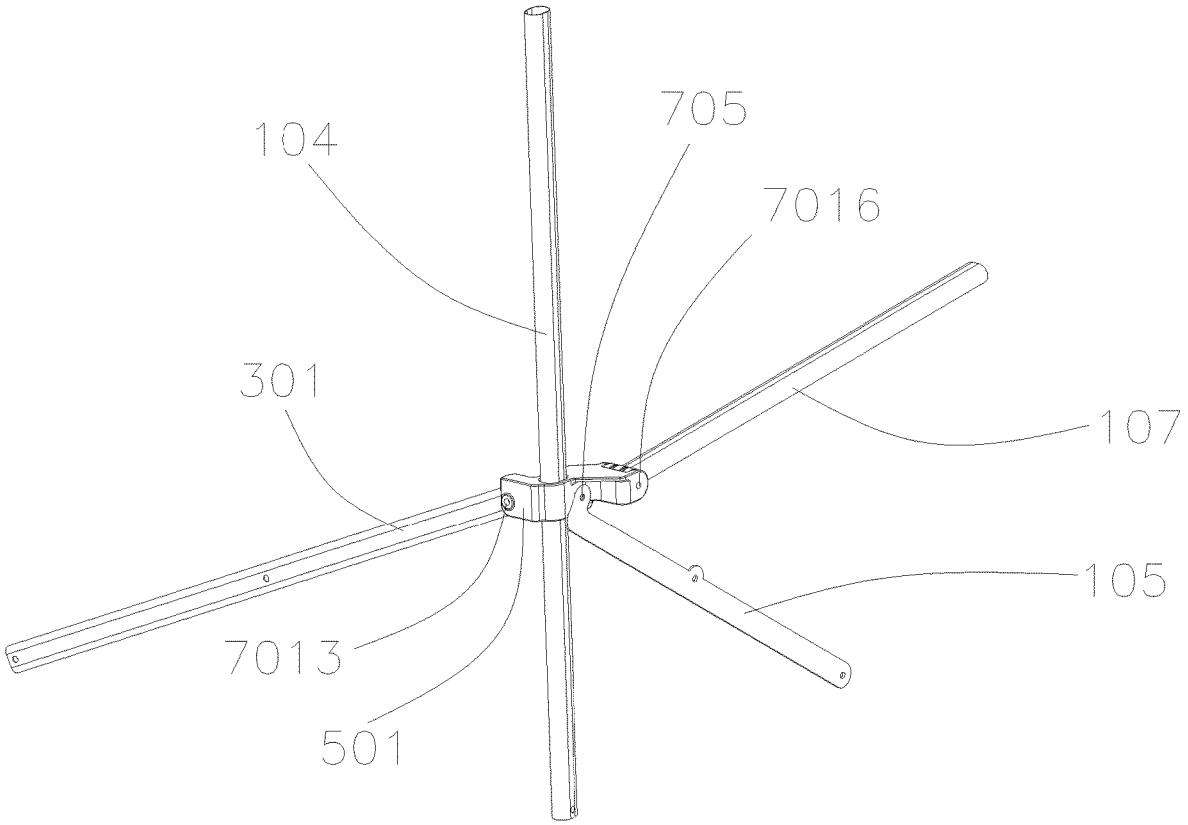
FIG. 9 is a structural schematic diagram showing the connection of a second transmission rod, an armrest rod, a first connecting rod, a second active rod and a first sliding sleeve.
Figure 10:
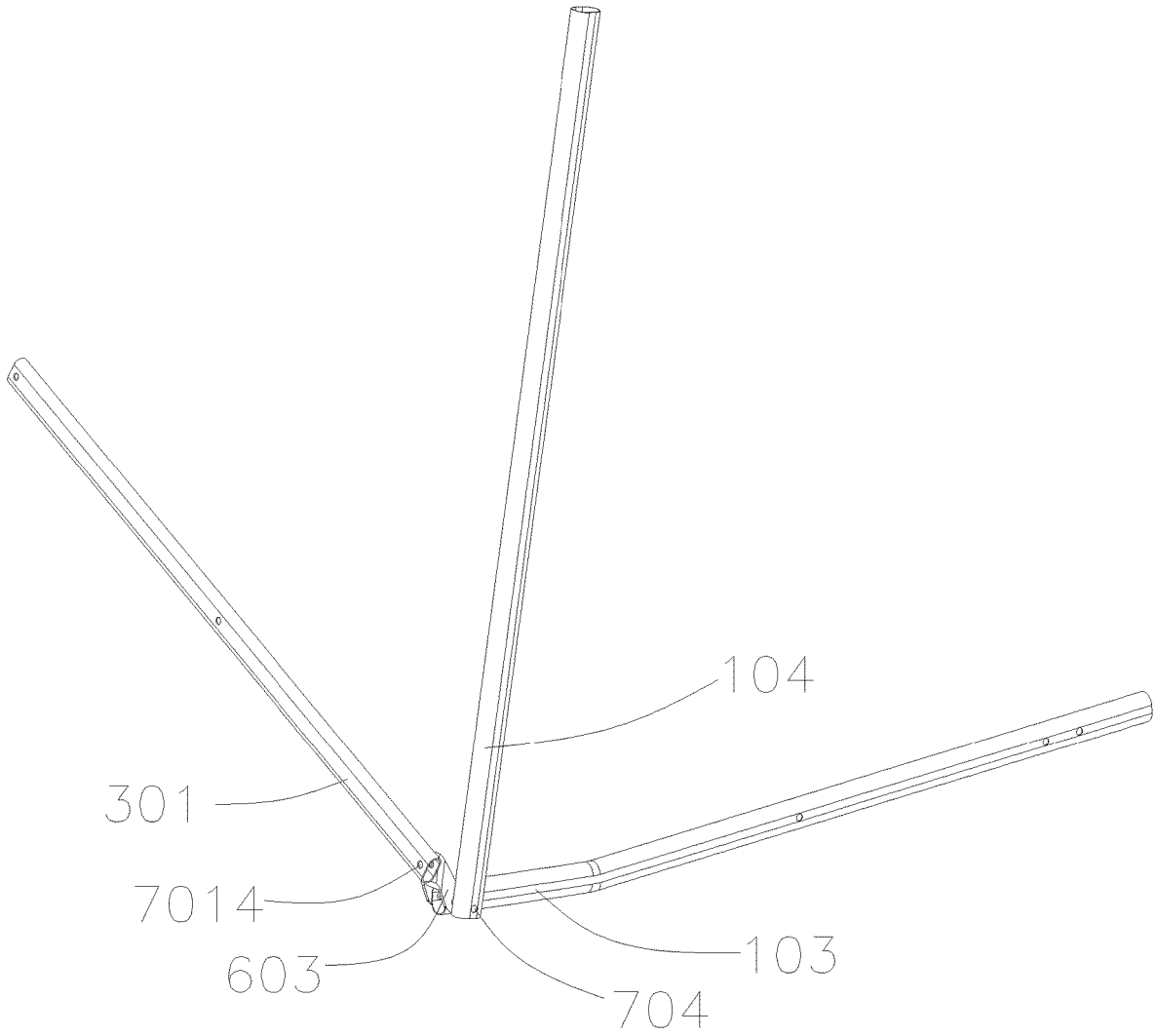
FIG. 10 is a structural schematic diagram showing the connection of the second transmission rod, the first active rod, the second active rod, and a third connecting component.
Figure 11:
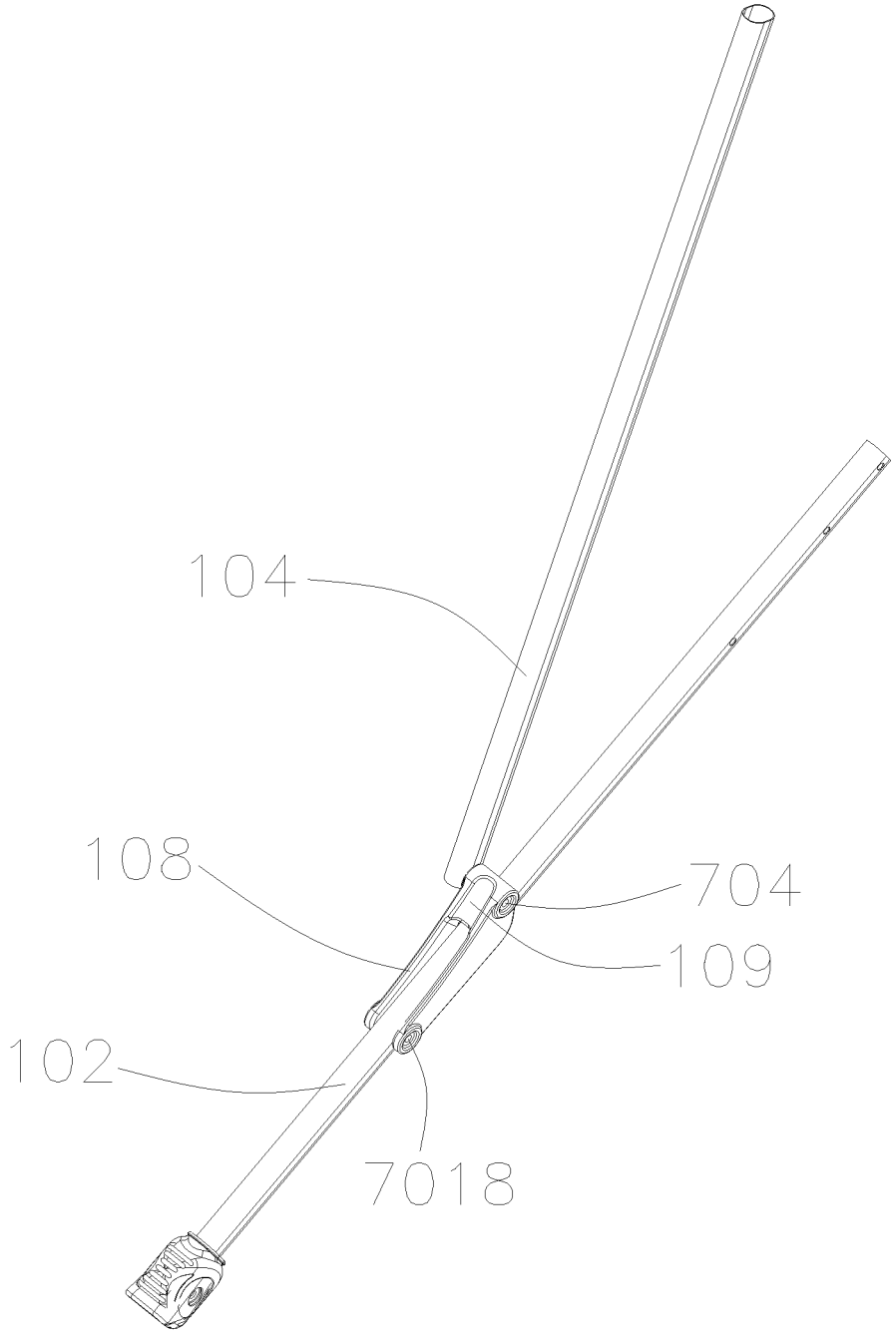
FIG. 11 is a structural schematic diagram showing the connection of a second supporting rod, the second active rod, and a second limiting rod.

As shown in FIGS. 1-11, the present disclosure provides Embodiment 1 of a folding chair, including:

Two folding mechanisms 1, wherein the two folding mechanisms are symmetrical about a first plane.

The folding mechanism 1 includes the first supporting rod 101, the second supporting rod 102, the first active rod 103, the second active rod 104, and the first connecting rod 105.

A first end portion of the first supporting rod 101 and a first end portion of the second supporting rod 102 are hinged at the first hinge point 701 through a first bolt and a first nut. An axis of the first bolt is perpendicular to the first plane.

The first connecting rod 105 and the second supporting rod 102 are hinged at the second hinge point 702 through a second bolt and a second nut. The second hinge point 702 is closer to a second end portion of the second supporting rod 102 than the first hinge point 701. The second hinge point 702 is located between a first end portion and a second end portion of the first connecting rod 105. An axis of the second bolt is perpendicular to the first plane.

The first active rod 103 and the first supporting rod 101 are hinged at the third hinge point 703 through a third bolt and a third nut. The third hinge point 703 is closer to a second end portion of the first supporting rod 101 than the first hinge point 701. The third hinge point 703 is located between a first end portion and a second end portion of the first active rod 103. An axis of the third bolt is perpendicular to the first plane.

A second end portion of the second active rod 104 and the second end portion of the first active rod 103 are hinged at the fourth hinge point 704 through a fourth bolt and a fourth nut. An axis of the fourth bolt is perpendicular to the first plane.

The first sliding sleeve 501 is fitted with the second active rod 104 in a sliding manner. The first end portion of the first connecting rod 105 and the first sliding sleeve 501 are hinged at the fifth hinge point 705 through a fifth bolt and a fifth nut. An axis of the fifth bolt is perpendicular to the first plane.

The first supporting rod 101 is fitted with the second sliding sleeve 502 in a sliding manner. The second sliding sleeve 502 is closer to the second end portion of the first supporting rod 101 than the third hinge point 703. The second end portion of the first connecting rod 105 and the second sliding sleeve 502 are hinged at the sixth hinge point 706 through a sixth bolt and a sixth nut. An axis of the sixth bolt is perpendicular to the first plane.

The first X-shaped folding frame 2 includes the two first transmission rods 201. Middle portions of the two first transmission rods 201 are hinged at the seventh hinge point 707 through a seventh bolt and a seventh nut. An axis of the seventh bolt is located on the first plane.

The first connecting component 601 is hinged to the first active rod 103. The first active rod 103 and the first connecting component 601 are hinged at the ninth hinge point 709 through a ninth bolt and ninth nut. The ninth bolt is closer to a first end portion of the first active rod 103 than the third bolt. An axis of the ninth bolt is perpendicular to the first plane.

A second end portion of the first supporting rod 101 is hinged to the second connecting component 602. The second end portion of the first supporting rod 101 and the second connecting component 602 are hinged at the tenth hinge point 7010 through a tenth bolt and a tenth nut. An axis of the tenth bolt is perpendicular to the first plane.

First end portions of the two first transmission rods 201 are respectively hinged to the two first connecting component 601 at the two eleventh hinge point 7011 through eleventh bolts and nuts. An axis of the eleventh bolt is parallel to the axis of the seventh bolt.

Second end portions of the two first transmission rods 201 are respectively hinged to the two second connecting components 602 at the two twelfth hinge point 7012 through twelfth bolts and nuts. An axis of the twelfth bolt is parallel to the axis of the seventh bolt.

The second X-shaped folding frame 3, includes the two second transmission rods 301. Middle portions of the two second transmission rods 301 are hinged at the eighth hinge point 708 through an eighth bolt and nut. An axis of the eighth bolt is located on the first plane.

The third connecting component 603 is hinged to the first active rod 103. The connecting component 603 and the first active rod 103 are hinged at the fourth hinge point 704.

First end portions of the two second transmission rods 301 are respectively hinged to the two first sliding sleeve 501 at the two thirteenth hinge points 7013 through thirteenth bolts and nuts. An axis of the thirteenth bolt is parallel to the axis of the eighth bolt.

Second end portions of the second transmission rods 301 are respectively hinged to the third connecting component 603 at the two fourteenth hinge points 7014. An axis of the fourteenth nut is parallel to the axis of the eighth nut The folding chair further includes the cloth surface 4. The cloth surface 4 is sewed with fourth sleeves which are respectively sleeved on the two second active rods 104 and first active rods 103. When the folding chair is unfolded, the cloth surface 4 between the two first active rods 103 forms a seat surface, and the cloth surface 4 between the two active rods 104 forms a backrest.

The principle of folding and unfolding the folding chair is as follows. When the chair is in a folded state, the user respectively grips the first end portion of the first active rods 103 and the first end portion of the second active rods 104 of any one of the folding mechanisms 1 by hand. When the user applies a force to increase a distance between the first end portion of the first active rods 103 and the second active rods 104, an angle between the first active rods 103 and the second active rods 104 increases, the first sliding sleeve 501 slides toward the second end portion of the second active rod 102, and the second sliding sleeve 502 slides toward the first end portion of the first supporting rod 101. Meanwhile, an angle between the first supporting rod 101 and the second supporting rod 102 also increases. In this way, the unfolding of the folding mechanism 1 is achieved. During the process of unfolding the folding mechanism 1, a distance between the ninth hinge point 709 and the tenth hinge point 7010 decreases, and a distance between the first sliding sleeve 501 and the fourth hinge point 704 also decreases. Correspondingly, a distance between the eleventh hinge point 7011 and the twelfth hinge point 7012 of the first X-shaped folding frame 2 decreases, and a distance between the two eleventh hinge points 7011 of the first X-shaped folding frame 2 increases. A distance between the thirteenth hinge point 7013 and the fourteenth hinge point 7014 of the second X-shaped folding frame 3 decreases. A distance between the two thirteenth hinge points 7013 of the second X-shaped folding frame 3 increases. Therefore, when one of the folding mechanisms 1 is unfolded, under the action of the first X-shaped folding frame 2 and the second X-shaped folding frame 3, the other folding mechanism 1 will be unfolded synchronously and a distance between the two folding mechanisms 1 will gradually increase. In this way, the whole folding chair is unfolded. After unfolding the folding chair, the second end portions of the two first supporting rods 101 and the second end portions of the two first supporting rods 102 form four legs of the folding chair.

When the folding chair is in an unfolded state, the user respectively grips any of the first end portions of the first active rods 103 and the first end portion of the second active rods 104 of any one of the folding mechanisms by hand. When the user applies a force to decrease the distance between the first end portion of the first active rod 103 and the first end portion of the second active rod 104, the angle between the active rods 103 and the second active rods 104 decreases, the first sliding sleeve 501 slides toward the second end portion of the second active rod 104, and the second sliding sleeve 502 slides toward the first end portion of the first supporting rod 101. Meanwhile, the angle between the first supporting rod 101 and the second supporting rod 102 also decreases, until the angle between the first supporting rod 101 and the second supporting rod 102 reaches a minimum. In this way, the folding mechanism 1 is folded. During the process of folding the folding mechanism 1, the distance between the ninth hinge point 709 and the tenth hinge point 7010 increases, and the distance between the first sliding sleeve 501 and the fourth hinge point 704 also increases. Correspondingly, the distance between the eleventh hinge point 7011 and the twelfth hinge point 7012 of the first X-shaped folding frame 2 increases; the distance between the two eleventh hinge points 7011 of the first X-shaped folding frame 2 decreases; the distance between the thirteenth hinge point 7013 and the fourteenth hinge point 7014 of the second X-shaped folding frame 3 increases, and the distance between the two thirteen hinge points 7013 of the second X-shaped folding frame 3 decreases. Therefore, when one of the folding mechanisms 1 is folded, under the action of the first X-shaped folding frame 2 and the second X-shaped folding frame 3, the other folding mechanism 1 will be folded synchronously and the distance between the two folding mechanisms 1 will gradually decrease. When the angle between the first supporting rod 101 and the second supporting rod 102 reaches to the minimum, the first supporting rod 101 abuts against the second supporting rod 102, the first active rod 103 abuts against the second active rod 104, the first connecting rod 105 abuts against the first supporting rod 101, and the two folding mechanisms 1 also abut against the first plane. At that time, the whole folding chair is folded.

Embodiment 2: On the basis of Embodiment 1, the folding mechanism 1 of the folding chair further includes the first limiting rod 106. A first end portion of the first limiting rod 106 and the first active rod 103 are hinged at the ninth hinge point 709.

The first supporting rod 101 is fitted with the third sliding sleeve 503 in a sliding manner. The third sliding sleeve 503 is closer to the second end portion of the first supporting rod 101 than the second sliding sleeve 502. A second end portion of the limiting rod 106 and the third sliding sleeve 503 are hinged at the fifteenth hinge point 7015 through a fifteenth bolt and a fifteenth nut. An axis of the fifteenth nut is perpendicular to the first plane.

In the present embodiment, during the process of unfolding the folding chair, the third sliding sleeve 503 slides toward the second end portion of the first supporting rod 101. When the third sliding sleeve 503 slides to abuts against the second connecting component 602, it functions as the limiting effect, thereby preventing the folding mechanism 1 from further unfolding, and ensuring the stability of the structure when the folding chair is unfolded. At that time, the folding chair is in the unfolded state.

Embodiment 3: On the basis of Embodiment 2, the folding mechanism 1 of the folding chair further includes the armrest rod 107. An extension section extends in a lengthwise direction of the first end portion of the second supporting rod 102.

The first end portion of the armrest rod 107 and the first sliding sleeve 501 are hinged at the sixteenth hinge point 7016 through a sixteenth bolt and a sixteenth nut. An axis of the sixteen bolt is perpendicular to the first plane.

The armrest rod 107 is fitted with the fourth sliding sleeve 504 in a sliding manner. An end portion of the extension section and the fourth sliding sleeve 504 are hinged at the seventeenth hinge point 7017 through a seventeenth bolt and a seventeenth nut. An axis of the seventeenth nut is perpendicular to the first plane.

In the present embodiment, during the process of folding the folding chair, the first sliding sleeve 501 slides toward the first end portion of the second active rod 104, and the fourth sliding sleeve 504 slides toward the first end portion of the armrest rod 107. After the folding chair is folded, the armrest rod 107 closes to the second supporting rod 102, so that the whole folded folding chair occupies small space.

During the process of unfolding the folding chair, the first sliding sleeve 501 slides toward the second end portion of the second active rod 104, and the fourth sliding sleeve 504 slides toward the second end portion of the armrest rod 107. After the folding chair is unfolded, the two armrest rods 107 form two armrests of the folding chair for laying the arm to relax the user comfortably.

Embodiment 4: On the basis of Embodiment 3, the folding mechanism 1 of the folding chair further includes the second limiting rod 108. A first end portion of the second limiting rod 108 and the second active rod 104 are hinged at the fourth hinge point 704.

A second end portion of the second limiting rod 108 and the second supporting rod 102 are hinged at the eighteenth hinge point 7018 through an eighteenth bolt and an eighth nut. The eighteenth hinge point 7018 is closer to the second end portion of the second supporting rod 102 than the second hinge point 702. An axis of the eighteenth bolt is perpendicular to the first plane.

The first portion of the second limiting rod 108 is fixedly provided with the limiting block 109. The limiting block 109 and the second end portion of the first supporting rod 101 are respectively located on two sides of the second supporting rod 102. The second limiting rod 108 can rotate around the eighteenth bolt. But when the first end portion of the second limiting rod 108 rotates to a position close to the second supporting rod 102, the limiting block 109 can abut against the second supporting rod 102 to prevent the second limiting rod 108 from continuing rotating.

In the present embodiment, when the folding chair is fully unfolded, the limiting block 109 abuts against the second supporting rod 102, and the limiting block 109 is closer to the first end portion of the second supporting rod 102 than the eighteenth bolt at that time, which ensures the stability of the structure when the folding chair is unfolded.

Embodiment 5, On the basis of Embodiment 3, the second supporting rod 102 is fitted with a fifth sliding sleeve in a sliding manner. The fifth sliding sleeve is closer to the second end portion of the second supporting rod 102 than the second hinge point 702.

The fifth sliding sleeve, the first active rod 103 and the second active rod 104 are hinged at the fourth hinge point 704.

In the present embodiment, during the process of unfolding the folding chair, the fifth sliding sleeve slides toward the first end portion of the second supporting rod 102 and drives the second supporting rod 102 to rotate around a first axis, so as to enlarge the angle between the first supporting rod 102 and the first supporting rod. During the process of folding the folding chair, the fifth sliding sleeve slides toward the second end portion of the second supporting rod 102 and drives the second supporting rod 102 to rotate around a first axis, so as to reduce the angle between the second supporting rod 102 and the first supporting rod.

It should be illustrated that the fifth sliding sleeve is not merely limited to be hinged at the fourth hinge point 704. The fifth sliding sleeve and the first active rod 103 may be hinged at the nineteenth hinge point. The nineteenth hinge point is located at a position on the first active rod 103 close to the fourth hinge point 704. The fifth sliding sleeve and the second active rod 104 may also be hinged at a twentieth hinge point. The twentieth hinge point is located at a position on the second active rod 104 close to the fourth hinge point 704.

In the description of the present specification, the terms 'one embodiment', 'some embodiments', 'example', 'specific example', or 'some examples' and the likes indicate that the specific features, the structures, the materials, or the characteristics described with reference to the embodiment or example are included in at least one embodiment or example of the present disclosure. In the present specification, the illustrative expression of the terms does not always refer to the same embodiment or example. Furthermore, the described specific features, structures, materials, or characteristics may be combined in a proper manner in any one or more embodiments or examples.

According to the preferred embodiments and the above descriptions of the present disclosure, the person skilled in the art may make various changes and modifications without departing the scope of the technical ideas derived from the present disclosure. The technical scope of the present disclosure is not limited to the content of the specification, but defined according to the claims.

What is claimed is:

1. A folding mechanism, comprising: a first supporting rod, a second supporting rod, a first active rod, a second active rod, and a first connecting rod; wherein a first end portion of the first supporting rod and a first end portion of the second supporting rod are hinged at a first hinge point; the first supporting rod and the second supporting rod are configured to rotate around a first axis passing through the first hinge point;

the first connecting rod and the second supporting rod are hinged at a second hinge point; the second hinge point is closer to a second end portion of the second supporting rod than the first hinge point; the second hinge point is located between a first end portion and a second end portion of the first connecting rod; the first connecting rod and the second supporting rod are configured to rotate around a second axis passing through the second hinge point;

the first active rod and the first supporting rod are hinged at a third hinge point, the third hinge point is closer to a second end portion of the first supporting rod than the first hinge point; the third hinge point is located between a first end portion and a second end portion of the first active rod; the first active rod and the first supporting rod are configured to rotate around a third axis passing through the third hinge point;

a second end portion of the second active rod and the second end portion of the first active rod are hinged at a fourth hinge point; the second active rod and the first active rod are configured to rotate around a fourth axis passing through the fourth hinge point;

the second active rod is fitted with a first sliding sleeve in a sliding manner, the first end portion of the first connecting rod and the first sliding sleeve are hinged at a fifth hinge point, the first sliding sleeve and the first connecting rod are configured to rotate around a fifth axis passing through the fifth hinge point;

the first supporting rod is fitted with a second sliding sleeve in a sliding manner; the second sliding sleeve is closer to the second end portion of the first supporting rod than the third hinge point; the second end portion of the first connecting rod and the second sliding sleeve are hinged at a sixth hinge point, the second sliding sleeve and the first connecting rod are configured to rotate around a sixth axis passing through the sixth hinge point; and the first axis, the second axis, the third axis, the fourth axis, the fifth axis, and the sixth axis are parallel to each other.

2. The folding mechanism according to claim 1, further comprising a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other.

3. The folding mechanism according to claim 2, further comprising a first limiting rod, a first end portion of the first limiting rod and the first active rod are hinged at a ninth hinge point, the ninth hinge point is closer to the first end portion of the first active rod than the third hinge point, the first limiting rod and the first active rod are configured to rotate around a ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around the fifteenth axis passing through the fifteenth hinge point; and the ninth axis, the fifteenth axis, and the first axis are parallel to each other.

4. The folding mechanism according to claim 2, further comprising an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

5. The folding mechanism according to claim 2, wherein the first end portion of the second limiting rod is fixedly provided with a limiting block, the limiting block and the second end portion of the first supporting rod are respectively located at two sides of the second supporting rod.

6. The folding mechanism according to claim 5, further comprising a first limiting rod, a first end portion of the first limiting rod and the first active rod are hinged at a ninth hinge point, the ninth hinge point is closer to the first end portion of the first active rod than the third hinge point, the first limiting rod and the first active rod are configured to rotate around a ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around the fifteenth axis passing through the fifteenth hinge point; and the ninth axis, the fifteenth axis, and the first axis are parallel to each other.

7. The folding mechanism according to claim 5, further comprising an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

8. The folding mechanism according to claim 1, wherein the second supporting rod is fitted with a fifth sliding sleeve in a sliding manner, and the fifth sliding sleeve is closer to the second end portion of the second supporting rod than the second hinge point;

the fifth sliding sleeve is hinged to the first active rod and/or the second active rod, and a hinge shaft and the first axis are parallel to each other.

9. The folding mechanism according to claim 8, further comprising a first limiting rod, a first end portion of the first limiting rod and the first active rod are hinged at a ninth hinge point, the ninth hinge point is closer to the first end portion of the first active rod than the third hinge point, the first limiting rod and the first active rod are configured to rotate around a ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around the fifteenth axis passing through the fifteenth hinge point; and the ninth axis, the fifteenth axis, and the first axis are parallel to each other.

10. The folding mechanism according to claim 8, further comprising an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

11. The folding mechanism according to claim 1, further comprising a first limiting rod, a first end portion of the first limiting rod and the first active rod are hinged at a ninth hinge point, the ninth hinge point is closer to the first end portion of the first active rod than the third hinge point, the first limiting rod and the first active rod are configured to rotate around a ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around a fifteenth axis passing through the fifteenth hinge point; and the ninth axis, the fifteenth axis, and the first axis are parallel to each other.

12. The folding mechanism according to claim 1, further comprising an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around the seventeenth axis passing through the seventeenth hinge point; and the sixteenth axis, the seventeenth axis, and the first axis are parallel to each other.

13. A folding chair, comprising two folding mechanisms according to claim 1, wherein the two folding mechanisms are symmetrical about a first plane; the first axis is perpendicular to the first plane;

the folding chair comprises a first X-shaped folding frame and a second X-shaped folding frame;

the first X-shaped folding frame comprises two first transmission rods, and middle portions of the two first transmission rods are hinged at a seventh hinge point, the two first transmission rods are configured to rotate around a seventh hinge axis passing through the seventh hinge point, and the seventh axis is located on the first plane;

a first connecting component is hinged to the first active rod, the first active rod and the first connecting component are hinged to a ninth hinge point, and the first active rod and the first connecting component are configured to rotate around a ninth axis;

the second end portion of the first supporting rod is hinged to a second connecting component, the second end portion of the first supporting rod and the second connecting component are hinged at a tenth hinge point, and the first supporting rod and the second connecting component are configured to rotate around a tenth axis passing through the tenth hinge point, and the tenth axis is perpendicular to the first plane;

first end portions of the two first transmission rods and the first connecting component are respectively hinged at two eleventh hinge points, a two eleventh axes respectively pass through the two eleventh hinge points and are parallel to the seventh axis, each first transmission rod and the first connecting component are configured to rotate around the tenth axis passing through the first transmission rod and the first connecting component;

second end portions of the two first transmission rods and two second connecting components are respectively hinged at two twelfth hinge points, the twelfth axes respectively pass through the two twelfth hinge points and are parallel to the seventh axis, and each first transmission rod and the second connecting component are configured to rotate around the twelfth axis passing through themselves the first transmission rod and the second connection component;

the second X-shaped folding frame comprises two second transmission rods, middle portions of the two second transmission rods are hinged at an eighth hinge point, the two second transmission rods are configured to rotate around a eighth hinge axis passing through the eighth hinge point, and the eighth axis is located on the first plane;

the first active rod is hinged with a third connecting component; the third connecting component and the first active rod are hinged at the fourth hinge point; the third connecting component is configured to rotate around the fourth axis;

first end portions of the two second transmission rods and the two first sliding sleeves are respectively hinged at two thirteenth hinge points, and two thirteenth axes respectively pass through the two thirteenth hinge points and are parallel to the eighth axis, and each second transmission rod and each first sliding sleeve are configured to rotate around a thirteenth axis passing through the second transmission rod; and second end portions of the two second transmission rods and two third connecting components are respectively hinged at two fourteenth hinge points, two fourteenth axes respectively pass through the two fourteenth hinge points and are parallel to the eighth axis, and each second transmission rod and each third connecting component are configured to rotate around a fourteenth axis passing through themselves.

14. The folding chair according to claim 13, further comprising a cloth surface, four sleeves are sewed on the cloth surface, and the two second active rods and first active rods are respectively inserted into the four sleeves.

15. The folding chair according to claim 13, wherein the folding mechanism further comprises a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other.

16. The folding chair according to claim 15, further comprising a cloth surface, four sleeves are sewed on the cloth surface, and the two second active rods and first active rods are respectively inserted into the four sleeves.

17. The folding chair according to claim 15, wherein the first end portion of the second limiting rod is fixedly provided with a limiting block, the limiting block and the second end portion of the first supporting rod are respectively located at two sides of the second supporting rod.

18. The folding chair according to claim 17, further comprising a cloth surface, four sleeves are sewed on the cloth surface, and the two second active rods and first active rods are respectively inserted into the four sleeves.

19. The folding chair according to claim 13, wherein the second supporting rod is fitted with a fifth sliding sleeve in a sliding manner, and the fifth sliding sleeve is closer to the second end portion of the second supporting rod than the second hinge point;

the fifth sliding sleeve is hinged to the first active rod and/or the second active rod, and a hinge shaft and the first axis are parallel to each other.

20. The folding chair according to claim 19, further comprising a cloth surface, four sleeves are sewed on the cloth surface, and the two second active rods and first active rods are respectively inserted into the four sleeves.

21. The folding chair according to claim 13, wherein the folding mechanism further comprises a first limiting rod, a first end portion of the first limiting rod and the first active rod are hinged at the ninth hinge point, the ninth hinge point is closer to the first end portion of the first active rod than the third hinge point, the first limiting rod and the first active rod are configured to rotate around the ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around a fifteenth axis passing through the fifteenth hinge point; and the ninth axis, the fifteenth axis, and the first axis are parallel to each other.

22. The folding chair according to claim 21, further comprising a cloth surface, four sleeves are sewed on the cloth surface, and the two second active rods and first active rods are respectively inserted into the four sleeves.

23. The folding chair according to claim 13, wherein the folding mechanism further comprises an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

24. The folding chair according to claim 23, further comprising a cloth surface, four sleeves are sewed on the cloth surface, and the two second active rods and first active rods are respectively inserted into the four sleeves.

25. The folding chair according to claim 13, wherein the folding mechanism further comprises a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other;

the folding mechanism further comprises a first limiting rod, a first end portion of the first limiting rod and the first active rod are hinged at the ninth hinge point, the ninth hinge point is closer to the first end portion of the first active rod than the third hinge point, the first limiting rod and the first active rod are configured to rotate around the ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around a fifteenth axis passing through the fifteenth hinge point; and the ninth axis, the fifteenth axis, and the first axis are parallel to each other.

26. The folding chair according to claim 13, wherein the folding mechanism further comprises a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other;

the first end portion of the second limiting rod is fixedly provided with a limiting block, the limiting block and the second end portion of the first supporting rod are respectively located at two sides of the second supporting rod;

the folding mechanism further comprises a first limiting rod, a first end portion of the first limiting rod and the first active rod are hinged at the ninth hinge point, the ninth hinge point is closer to the first end portion of the first active rod than the third hinge point, the first limiting rod and the first active rod are configured to rotate around the ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around a fifteenth axis passing through the fifteenth hinge point; and the ninth axis, the fifteenth axis, and the first axis are parallel to each other.

27. The folding chair according to claim 13, wherein the second supporting rod is fitted with a fifth sliding sleeve in a sliding manner, and the fifth sliding sleeve is closer to the second end portion of the second supporting rod than the second hinge point;

the fifth sliding sleeve is hinged to the first active rod and/or the second active rod, and a hinge shaft and the first axis are parallel to each other;

the folding mechanism further comprises a first limiting rod, a first end portion of the first limiting rod and the first active rod are hinged at the ninth hinge point, the ninth hinge point is closer to the first end portion of the first active rod than the third hinge point, the first limiting rod and the first active rod are configured to rotate around the ninth axis passing through the ninth hinge point;

the first supporting rod is fitted with a third sliding sleeve in a sliding manner, and the third sliding sleeve is closer to the second end portion of the first supporting rod than the second sliding sleeve; the second end portion of the first limiting rod and the third sliding sleeve are hinged at a fifteenth hinge point, and the first limiting rod and the third sliding sleeve are configured to rotate around a fifteenth axis passing through the fifteenth hinge point; and the ninth axis, the fifteenth axis, and the first axis are parallel to each other.

28. The folding chair according to claim 13, wherein the folding mechanism further comprises a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other;

the folding mechanism further comprises an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

29. The folding chair according to claim 13, wherein the folding mechanism further comprises a second limiting rod, a first end portion of the second limiting rod and the second active rod are hinged at the fourth hinge point, the second limiting rod is configured to rotate around the fourth axis;

a second end portion of the second limiting rod and the second supporting rod are hinged at an eighteenth hinge point, the eighteenth hinge point is closer to the second end portion of the second supporting rod than the second hinge point; the second limiting rod and the second supporting rod are configured to rotate around an eighteenth axis passing through the eighteenth hinge point; and the eighteenth axis and the first axis are parallel to each other;

the first end portion of the second limiting rod is fixedly provided with a limiting block, the limiting block and the second end portion of the first supporting rod are respectively located at two sides of the second supporting rod;

the folding mechanism further comprises an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

30. The folding chair according to claim 13, wherein the second supporting rod is fitted with a fifth sliding sleeve in a sliding manner, and the fifth sliding sleeve is closer to the second end portion of the second supporting rod than the second hinge point;

the fifth sliding sleeve is hinged to the first active rod and/or the second active rod, and a hinge shaft and the first axis are parallel to each other;

the folding mechanism further comprises an armrest rod, the first end portion of the second supporting rod extends in a longitudinal direction of the second supporting rod to form an extension section;

a first end portion of the armrest rod and the first sliding sleeve are hinged at a sixteenth hinge point, and the armrest rod and the first sliding sleeve are configured to rotate around a sixteenth axis passing through the sixteenth hinge point.

the armrest rod is fitted with a fourth sliding sleeve in a sliding manner, and an end portion of the extension section and the fourth sliding sleeve are hinged at a seventeenth hinge point, and the extension section and the fourth sliding sleeve are configured to rotate around a seventeenth axis passing through the seventeenth hinge point; and the sixteenth axis, the seventeenth axis, and the first axis are parallel to each other.

* * * * *